US006861934B2

(12) United States Patent
Strom

(10) Patent No.: US 6,861,934 B2
(45) Date of Patent: Mar. 1, 2005

(54) UNIPOLAR MAGNETIC SYSTEM

(76) Inventor: Carl H. Strom, 25462 Galashields Cir., Bonita Springs, FL (US) 34134

( * ) Notice: Subject to any disclaimer, the term of this patent is extended or adjusted under 35 U.S.C. 154(b) by 89 days.

(21) Appl. No.: 10/760,964

(22) Filed: Jan. 20, 2004

(65) Prior Publication Data

US 2004/0145436 A1 Jul. 29, 2004

Related U.S. Application Data

(63) Continuation-in-part of application No. 10/431,240, filed on May 7, 2003.
(60) Provisional application No. 60/441,595, filed on Jan. 22, 2003.

(51) Int. Cl.[7] ..... H01F 7/02
(52) U.S. Cl. ..... 335/306
(58) Field of Search ..... 335/302–306

(56) References Cited

U.S. PATENT DOCUMENTS 4,222,021 A * 9/1980 Bunker, Jr. ..... 335/296
5,506,558 A * 4/1996 Laube ..... 335/306

* cited by examiner

*Primary Examiner*—Ramon M. Barrera
(74) *Attorney, Agent, or Firm*—William F. Hamrock, P.A.

(57) ABSTRACT

A unipolar magnetic system has a plurality of external magnetic poles oppositely charged from a plurality of internal magnetic poles forcibly joined together in a unipolar magnet. Included can be a plurality of bipolar magnets juxtaposed forcibly joined together forming a unipolar magnetic solid. The bipolar magnets can be secured to a central nonmagnetic core object forming the unipolar magnetic solid. The plurality of bipolar magnets can include wedge magnets forcibly bound together and secured to nonmagnetic metal core object. The wedge magnets can be secured to the nonmagnetic core metal object by magnetic metal screws. The nonmagnetic core object can be in the form of a cube, polyhedron or other form and the metal can be aluminum, other nonmagnetic metal or other nonmagnetic material. The unipolar magnet can be in the form of a sphere, cube, polyhedron or other form. The unipolar magnetic system is applicable to a bi-valved nonmagnetic cube having radially placed electromagnetic rods wherein the distal ends of the electromagnetic rods line the surface of its hollow cavity creating the internal magnetic field.

20 Claims, 6 Drawing Sheets

UNIPOLAR MAGNETIC SYSTEM

The present application is a continuation in part of Ser. No. 10/431,240, filed May 7, 2003, which claims priority to U.S. Provisional Application Ser. No. 60/441,595, filed Jan. 22, 2003, the entirety which is incorporated into Ser. No. 10/431,240 and the present application.

BACKGROUND OF THE INVENTION

Known magnets are bipolar with positive (north) polarity oppositely disposed from negative (south) polarity. Unipolar magnetic systems do not exist in nature. There are no known unipolar magnetic systems. A unipolar magnetic system has a single polarity, either north or south, internally or externally on a unipolar magnetic system. The present continuation in part application more clearly defines the invention disclosed in Provisional Application Ser. No. 60/441,595 and Application Ser. No. 10/431,240 of forcibly fixing a plurality of magnets to the surface of a three-dimensional object

SUMMARY OF THE INVENTION

The present application more clearly defines preferred embodiments of the invention of constructing unipolar magnets by forcibly binding the magnets to an object. This is accomplished by arranging and binding a plurality of magnets in such a fashion to create a solid structure which has a unipolar external polarity and a unipolar internal polarity. The binding forces which hold the magnets together must exceed and overcome the repulsion forces exerted by the adjacent magnet having the same magnetic charge. Extraordinary benefits are derived, not only from the uniqueness of the creation of the unipolar magnets in not having existed previously, but also from the magnitude of practical applications evolving from the use of the unipolar magnets. Bipolar magnetism for the unipolar magnetic system can be permanent or electrically charged.

Several systems are provided to form the unipolar magnet solid structures. It is essential to carefully select the system of fabrication and placement in forming the desired structure. A number of preferred techniques have been developed for binding the magnets together and securing the bound components to the object to form the unipolar solid structure. Such binding techniques include binding straps, screws attaching magnets to an internal core object, high PSI epoxy adhesives and similar adhesives. The unipolar solid structures include a sphere, cube, octahedron, duodecahedron, other polyhedron and similar solid structures. The formation of the solid structure simultaneously creates an external unipolar magnetic field and an encompassed internal oppositely charged unipolar magnetic field secured to the internal core object . Provided is a unipolar solid structure having a plurality of externally charged magnetic poles which are oppositely charged magnetically from a plurality of internally charged magnetic poles. This is accomplished with a plurality of bipolar magnets juxtaposed bound and secured to the internal core object.

When specially machined magnets are arranged to form the solid structure, the entire external surface has a uniform polarity, the solid structure acts as a unipolar magnet. This is the crux of the present invention, whereby the magnets are bound together with forces stronger than the repulsion forces resisting the formation of the unipolar magnetic solid structure and overcoming the repulsion forces.

In a preferred embodiment of the present invention, a plurality of magnets are joined together and secured by screws inserted through the magnets to a central non-magnetic metal core object in making a sphere, cube, duodecahedron or similar configuration. The central core object can be an aluminum cube or other non-magnetic metal object, strong enough to retain the screws against the repulsion forces of the magnets. Opposing locking mechanisms are provided on each of the core object's sides and adjoining internal magnetic pole to lock in the magnet, and a threaded recessed aperture is positioned in the center of each side to secure the threaded screw head. A plurality of specially fabricated bipolar magnets, such as neodymium magnets or similar magnets, each magnet positioned to fit squarely on the surface of each side of the core object and to closely engage adjacent bipolar magnets and mating locking mechanism on the core object, are forcibly bound together and secured to the cube core by rigid, durable highly magnetic metal screws. The shafts of the screws pass through tight fitting screw slots in the magnet components with the threaded ends of the screw shafts secured within the mating threaded aperture of the non-magnetic metal core. The outer screw heads are contoured to conform perfectly with the contour of the sphere or other solid structure configuration.

BRIEF DESCRIPTION OF DRAWINGS

This invention is described by appended claims in relation to description of preferred embodiments with reference to the following drawings which are explained briefly as follows:

DESCRIPTION OF PREFERRED EMBODIMENTS

Figure 1:
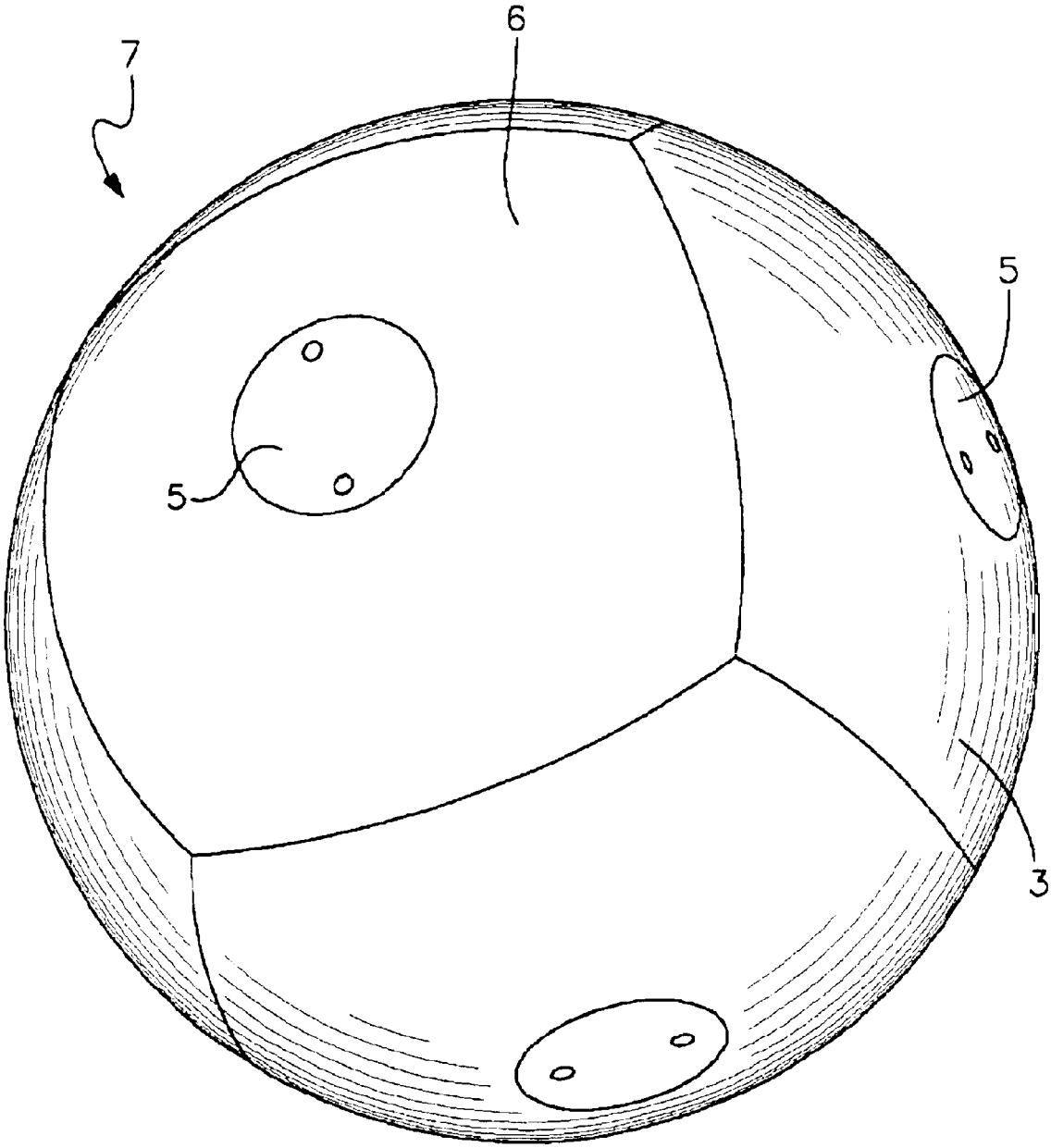
FIG. 1 is a front elevation view of a unipolar magnetic system in the configuration of a sphere illustrating the contour of the magnetic components and the screws.

Listed numerically below with reference to the drawings are terms used to describe features of the invention.

1. External magnetic pole
2. Internal magnetic pole
3. Bipolar magnet
4. Non-magnetic metal core object
5. Binding screws
6. Unipolar magnetic solid
7. Sphere
8. Arcuate wedge magnets

9. Aluminum cube core object

10. Screw slots

11. Recessed aperture

12. Locking groove

13. Fin

14. Unipolar magnetic cube

15. Pyramidal wedge bipolar magnets

16. Unipolar magnetic duodecahedron

17. Hollow bi-valved aluminum cube

18. Electromagnetic rods

19. Hollow cavity

20. Distal ends of electromagnets

21. Locking mechanism

The unipolar magnetic system of the invention is prepared by juxtaposed joining together a plurality of bipolar magnets forming a unipolar magnet. Applicant has been able to accomplish this by use of various binding means to secure the magnets together. In a preferred embodiment of this invention shown in FIGS. 1–5, a plurality of bipolar magnets 3 are juxtaposed joined together to form a unipolar magnet secured to a central non-magnetic core object 4, preferably by binding screws 5 forming a unipolar magnetic solid 6 having a plurality of external magnetic poles 1 and oppositely charged internal magnetic poles 2. In the unipolar magnetic system as shown, the external unipolar magnetic pole 1 of the unipolar magnetic solid is north and the internal magnetic pole 2 is south. Optionally, the external unipolar magnetic pole of the unipolar magnetic solid can be south and the internal magnetic pole can be north. The central non-magnetic metal core object 4 is made of aluminum or other non-magnetic metal or nonmagnetic material, each of which must be durable and rigid in order to overcome the repulsion forces of the internal magnet poles 2 by retaining the binding screws 5 secured in the non-magnetic metal, or non-magnetic material, core object in securing the bipolar magnets 3 in the unipolar magnetic solid.

Figure 2:
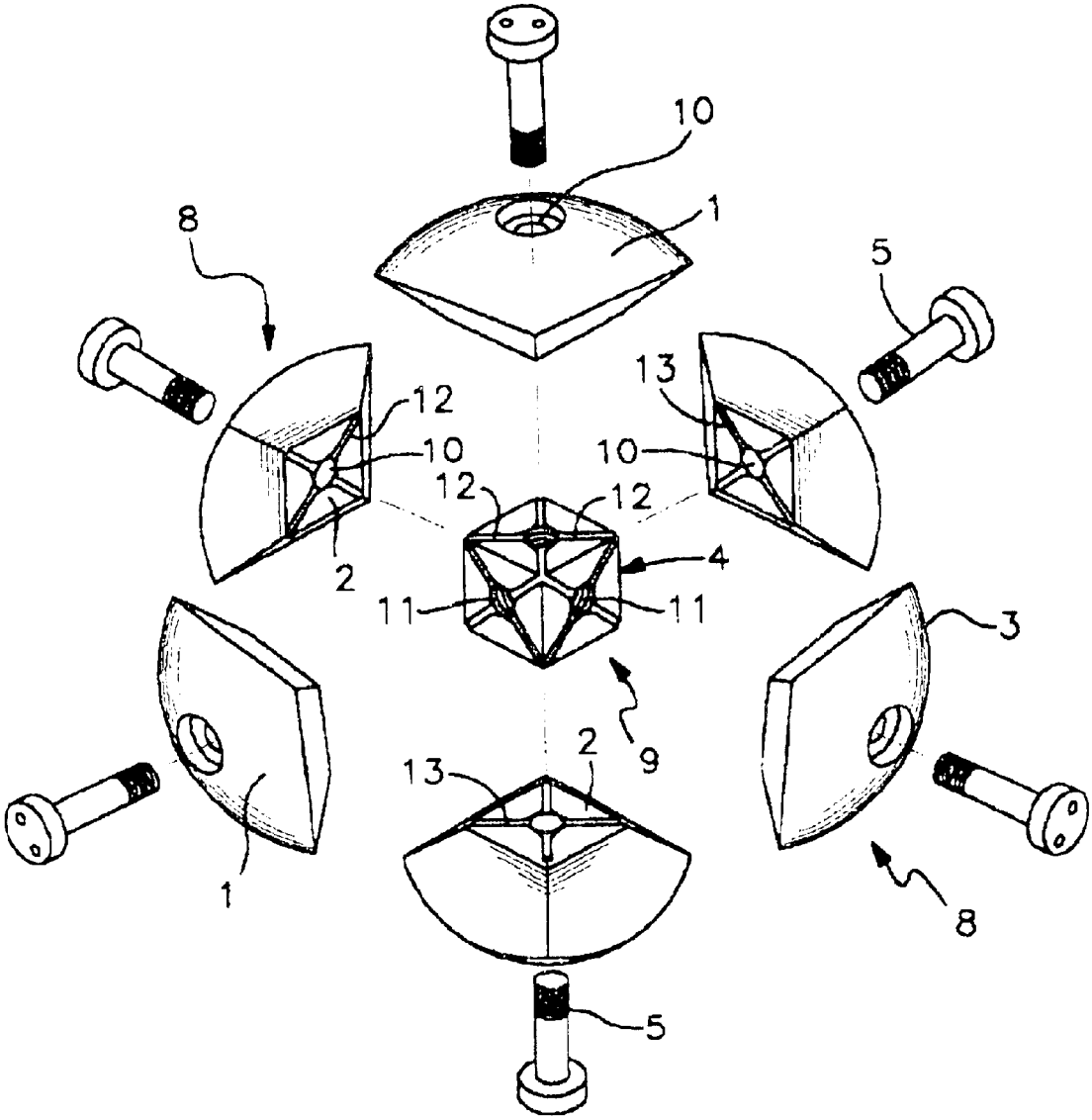
FIG. 2 is an elevation exploded view illustration of FIG. 1 illustrating the placement and contour of the six wedge shaped magnetic components, six screws and the cube core object.

In the embodiment shown in FIGS. 1–2, the unipolar magnetic solid is in the form of a sphere 7, seen in FIG. 1, having six specially fabricated spherically arcuate wedge bipolar neodymium magnets 8 joined together and secured to the six sides of an aluminum cube core object 9, seen in the exploded FIG. 2. The shafts of six rigid, highly magnetic metal binding screws 5 pass through tight fitting, smooth slots 10 in the magnets having the threaded end of the shafts secured in threaded recessed aperture 11 in the cube core object. Opposing mating locking groove 12 provided on the cube core and locking fin 13 on the adjoining internal magnetic pole are coupled together to further secure the magnets. Each magnet is positioned to fit squarely on each surface of the core object to closely engage the adjacent bipolar magnets. Gaussage must be uniform at all points on the surface of the sphere The exterior surfaces of the screw heads are contoured to conform perfectly with the contour of the sphere. The heads of the screws are machined in a manner requiring the least break in the smooth surface of the sphere, such as drawing rendition or Phillips head or slot head or other means, and which can be filled with a similar magnetic material after the sphere has been assembled. All components are closely fitted together providing a smooth, uniform surface with nearly imperceptible seams.

Figure 3:
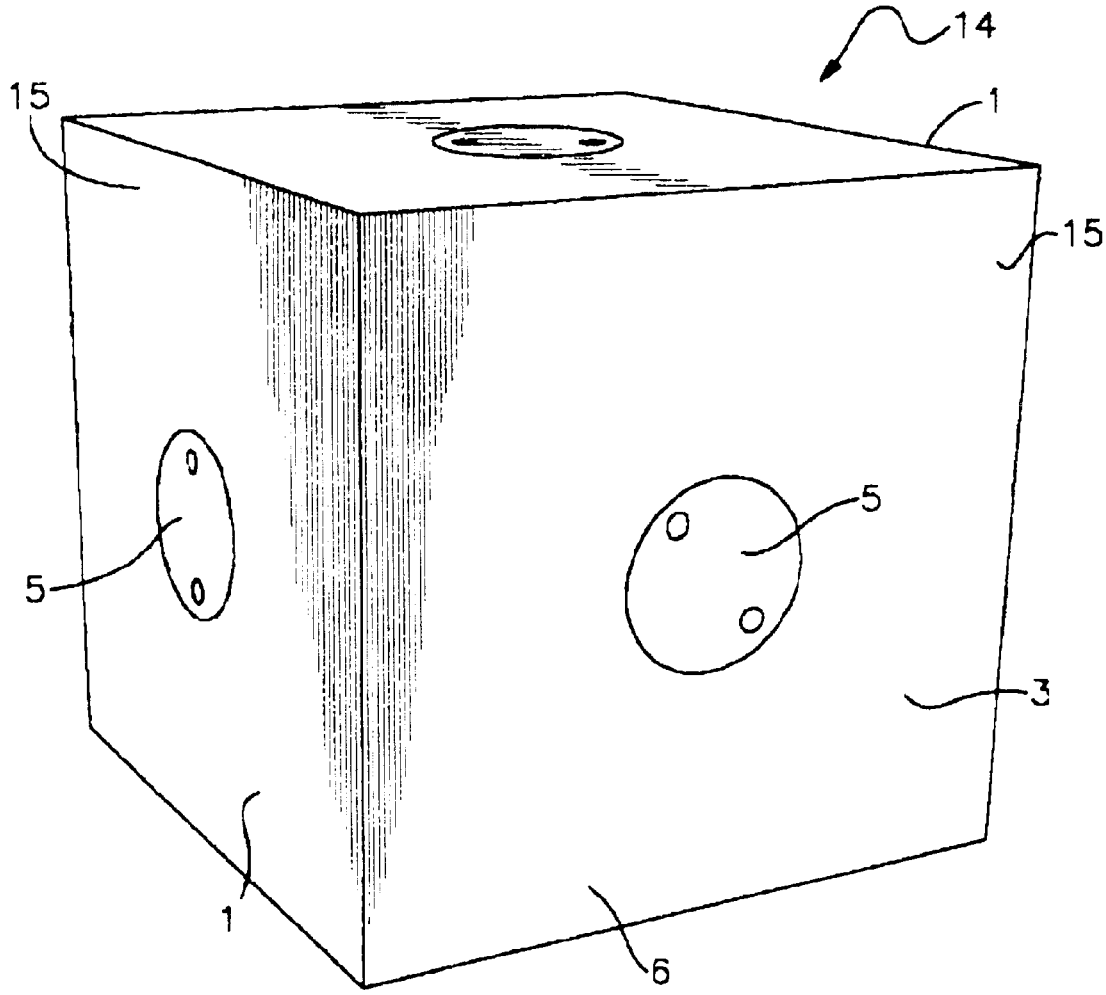
FIG. 3 is a side elevation view of a unipolar magnetic system in the configuration of a cube illustrating the contour of the magnetic components and the screws.
Figure 4:
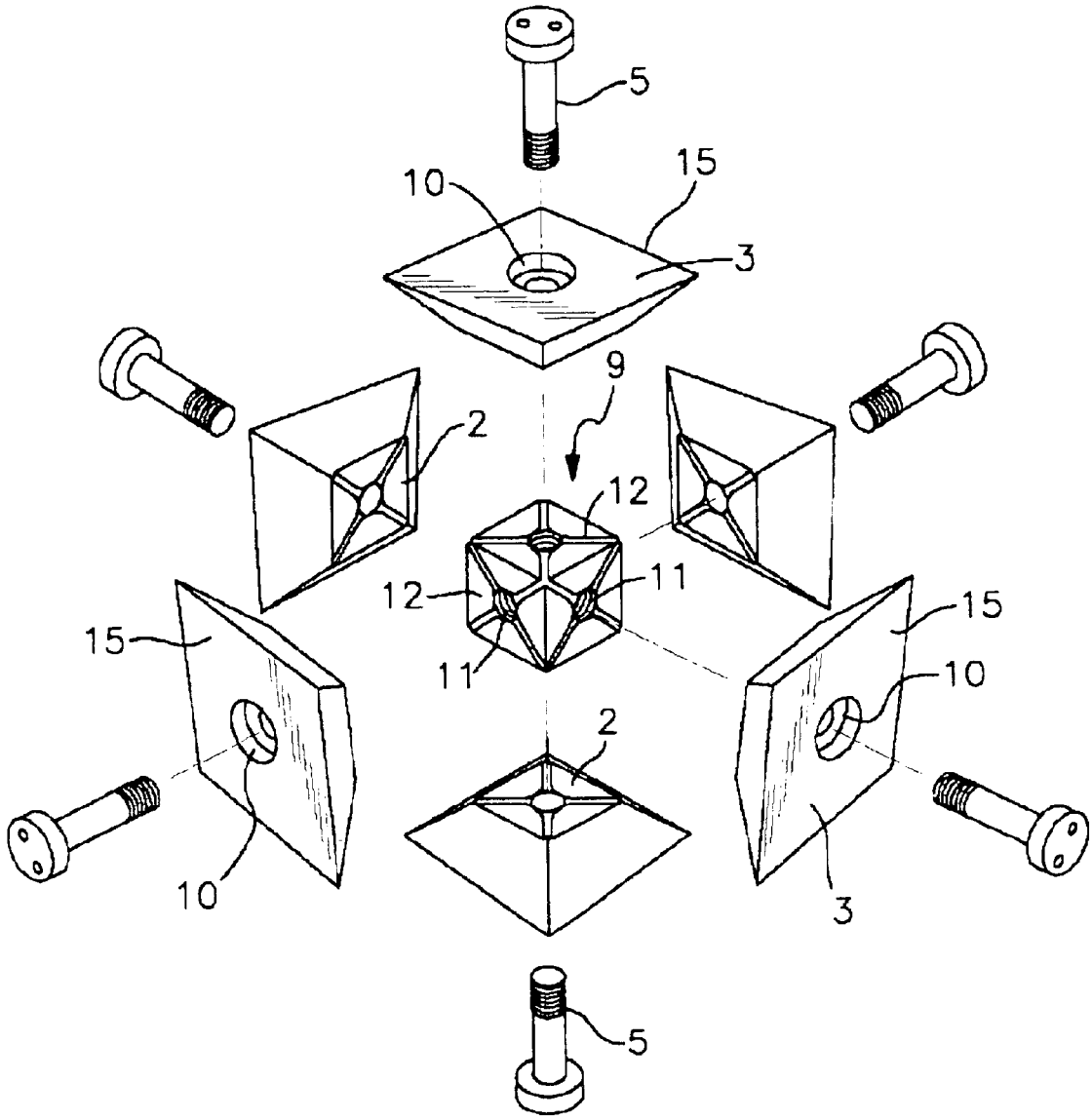
FIG. 4 is an elevation exploded view illustration of FIG. 3 illustrating the placement and contour of the six wedge shaped magnetic components, six screws and the cube core object.

In the embodiment shown in FIGS. 3–4, the uniplolar magnetic solid is in the form of a cube 14, seen in FIG. 3, having six specially fabricated inverted pyramidal wedge bipolar neodymium magnets 15 joined together and secured to an aluminum cube core object 9, seen in the exploded FIG. 4. The shafts of six rigid, highly magnetic binding screws 5 pass through the tight fitting, smooth slots 10 in the magnets having the threaded end of the shaft secured in the threaded recessed aperture 11 in the cube core object 9. Opposing mating locking groove on the cube core object and the locking fin 13 on the adjoining internal magnetic pole are coupled together to further secure the magnets. Gaussage must be uniform in all points on the surface of the unipolar magnetic cube 14. The exterior surfaces of the screw heads must be contoured to conform with the contour of cube 14 and the heads of the screws machined accordingly as previously described. All components of the unipolar magnetic cube provide a smooth, uniform surface with nearly imperceptible seams.

Figure 5:
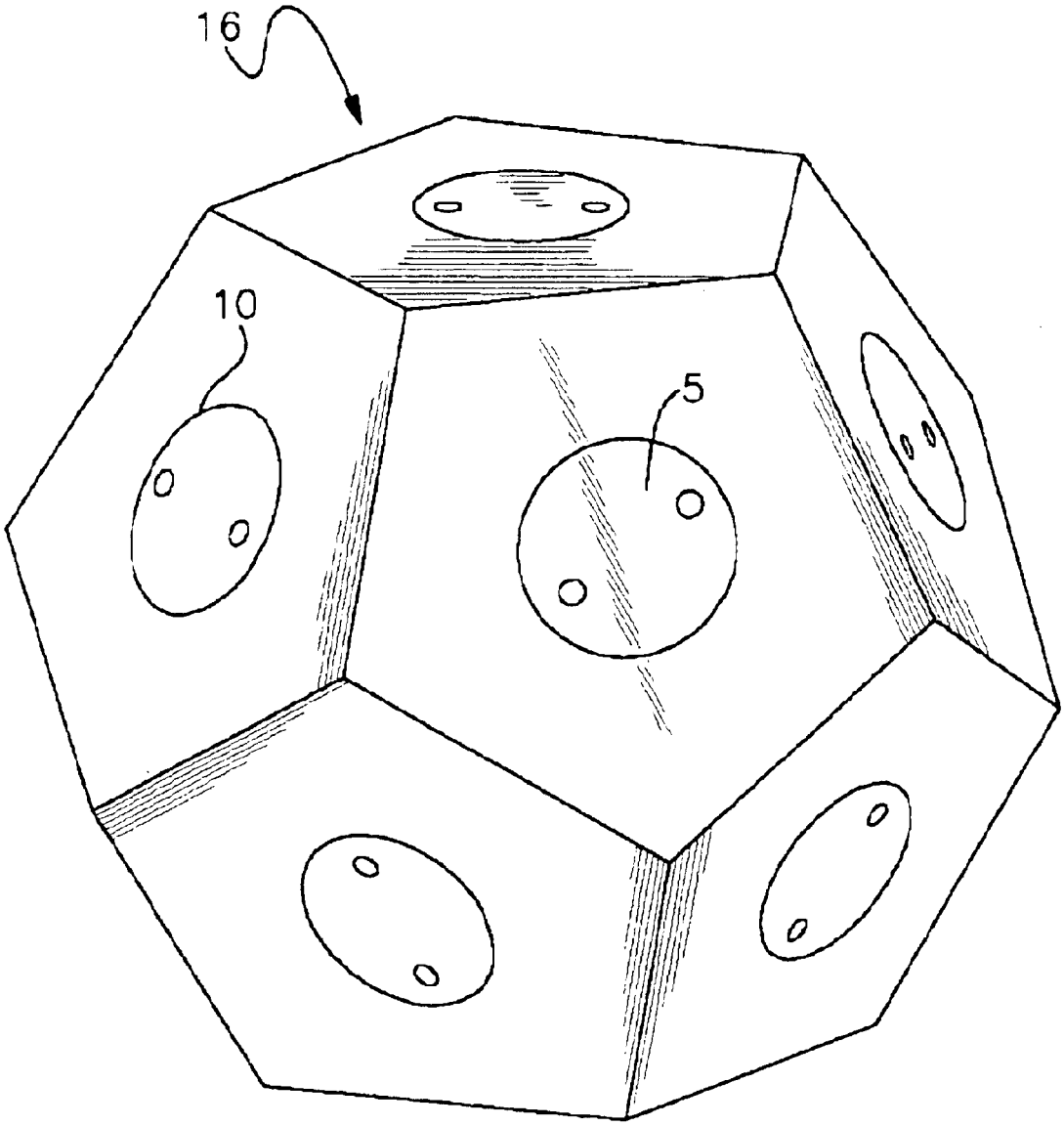
FIG. 5 is a side elevation view of a unipolar magnetic system in the configuration of a duadecahedron the contour of the magnetic components and the screws.

Shown in FIG. 5, the unipolar magnet solid is in the form of a polyhedron, in this embodiment a duodecahedron 16, seen in FIG. 5, having of twelve twelve specially fabricated five sided polyhedron wedge bipolar neodymium magnets, not shown, joined together and secured to an aluminum duodecahedron core object, not shown. The shafts of the twelve rigid, highly magnetic screws 5 pass through tight fitting, smooth slots 10 in the magnets having the threaded end of the shaft secured in the threaded recessed aperture in the polyhedron duodecahedron core object. Opposing mating locking groove on core object and fin on the adjoining internal magnetic pole, not shown, are coupled together to further secure the magnets. Gaussage must be uniform on all parts of the unipolar magnetic duodecahedron 16, The exterior surface of the screws must be contoured to conform to the contour of the duodecahedron and the heads of the screws machined accordingly as previously described. All components of the unipolar magnetic polyhedron 16 provide a smooth, uniform surface with nearly imperceptible seams.

With respect to basic research, an important embodiment of the invention would be the multiple science applications from the study and evaluation of the effect of varying the intensity of enclosed internal electromagnetic unipolar electromagnetic fields on various life forms and substances.

Although permanent magnets are mainly disclosed herein, electromagnets can be used as well with modifications. This is specifically true, and much more feasible, where the desired end product is an internal unipolar magnetic field, as would be necessary to have access to the inner chamber created by such a device in any practical manner.

Electromagnets also allow an on/off state not possible with permanent magnets. Magnetic field strength variation is also possible with electromagnets. For example, extremely intense internal unipolar fields can be achieved with electromagnets. These features allow the device to be a valuable tool in basic research investigating the influence and effects of unipolar magnetic fields on many life forms and other substances.

Figure 6:
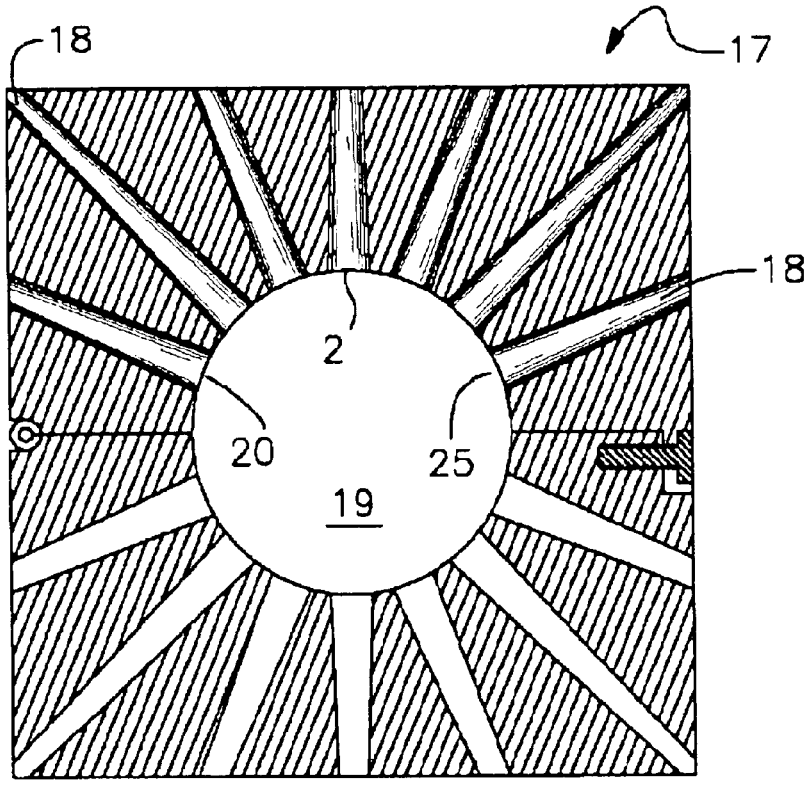
FIG. 6 is a cross-section view of a bi-valved hollow aluminum cube with electromagnetic rods shown only in top half.
Figure 7:
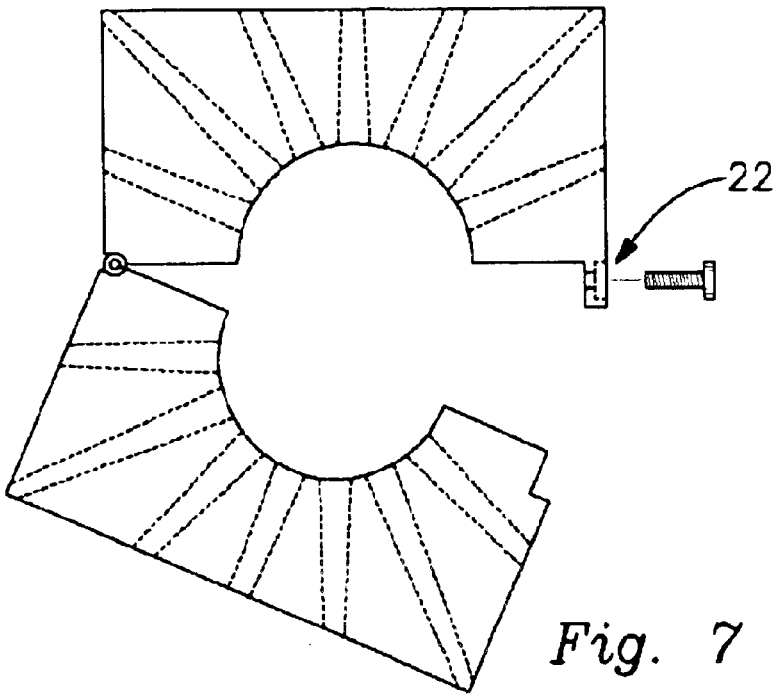
FIG. 7 is an external view of FIG. 6 showing how the aluminum cube is bolted together.

Shown in FIGS 6 and 7 are radially placed electromagnets rods 18 in constructing a thick walled, hollow, bi-valved, aluminum cube 17. The surface of the hollow cavity 19 in cube 17 is lined by distal ends 20 of the electromagnetic rods. Cavity 21 inside the cube functions as the internal unipolar magnetic field 2. The external view in FIG 7 shows the bi-valve requires a strong locking mechanism 22 to generate enormous field forces with the device.

Electromagnetism is one of the strongest forces in nature like the "strong force" and gravity. As the electromagnetic force and "weak force" are related, a relationship between gravity and electromagnetism possibly exists also. As various unipolar prototypes are made, precise weights of the components, before and after construction, are secured to identify deviations which suggest a kinship between these two forces.

A new and useful unipolar magnetic system having been described, all such foreseeable modifications, adaptations, substitution of equivalents, mathematical possibilities of combination of parts, pluralities of parts, applications and forms thereof as described by the following claims and not precluded by the prior art are included in this invention.

What is claimed is:

1. The unipolar magnetic system comprising:

a plurality of magnetically bipolar magnets which each has a commonly magnetic external pole that is external from a commonly magnetic internal pole which is oppositely charged magnetically from a commonly magnetic external pole of each of the polarity of the bipolar magnets forcibly bound together to a nonmagnetic cube core of a unipolar magnetic solid wherein internal magnetic poles securely engage opposing locking grooves on opposing sides of the cube core.

2. The unipolar magnetic system of claim 1 wherein:

the unipolar magnetic system includes a uniploar magnetic solid for which the external magnetic pole of each of the plurality of magnetically bipolar magnets is north and the internal magnetic pole of each of the plurality of magnetically bipolar magnets is south.

3. The unipolar magnetic system of claim 1 wherein:

the unipolar magnetic system includes a unipolar magnetic solid for which the external magnetic pole of each of the plurality of magnetically bipolar magnets is south and the internal magnetic pole of each of the of the plurality of magnetically bipolar magnets is north.

4. The unipolar magnetic system of claim 1 wherein:

the plurality of magnetically bipolar magnets include wedge magnets having adjacent sides which are forcibly bound together.

5. The unipolar magnetic system of claim 4 wherein:

the cube core object having external sides, the wedge magnets include external magnetic poles forming external faces of the solid unipolar magnetic solid, the wedge magnets include internal magnetic poles adjacently forcibly secured to external sides of the cube core object.

6. The unipolar magnetic system of claim 5 wherein:

the wedge magnets are forcibly secured to the core object by means of magnetic metal screws each of which passes through a wedge magnet to be secured to the side of the core object.

7. The unipolar magnetic system of claim 6 wherein:

the nonmagnetic core object is made of a nonmagnetic metal.

8. The unipolar magnetic system of claim 7 wherein the nonmagnetic metal is aluminum.

9. The unipolar magnet system of claim 6 wherein:

the wedge magnets are spherically arcuate bipolar magnets.

10. The unipolar magnetic system of claim 9 wherein:

six spherically arcuate bipolar magnets are secured to a six sided cube object.

11. The unipolar magnetic system of claim 10 in the form of a sphere.

12. The unipolar magnetic system of claim 6 wherein:

the wedge magnets are inverted pyramidal bipolar magnets.

13. The unipolar magnetic system of claim 12 wherein:

six inverted pyramidal bipolar magnets are secured to a six sided cube object.

14. The unipolar magnetic system of claim 13 in the form of a cube.

15. The unipolar magnetic system of claim 6 in the form of a polyhedron.

16. The unipolar magnetic system of claim 15 in the form of a duodecapolyhedron.

17. A unipolar magnetic system comprising:

a bi-valved nonmagnetic cube having radially placed electromagnetic rods and a hollow cavity.

18. The unipolar magnetic system of claim 17 wherein:

the electromagnetic rods having distal ends lining the surface of the hollow cavity.

19. The unipolar magnetic system of claim 18 wherein:

the surface of the cavity has an internal magnetic field.

20. The unipolar magnetic system of claim 19 wherein:

the nonmagnetic cube is made of aluminum.

* * * * *